United States Patent [19]

Spoonster, Sr., deceased

[11] Patent Number: 4,869,511

[45] Date of Patent: Sep. 26, 1989

[54] GOLFER'S TRAINING DEVICE

[75] Inventor: Joseph R. Spoonster, Sr., deceased, late of Barberton, Ohio, by Dorothy R. Spoonster, executor

[73] Assignee: Golfercise, Inc., Akron, Ohio

[21] Appl. No.: 206,284

[22] Filed: Jun. 14, 1988

[51] Int. Cl.[4] ..... A63B 69/36

[52] U.S. Cl. ..... 273/194 B; 273/81 A; 273/81 D; 273/81.2; 273/81.4

[58] Field of Search ..... 273/194 R, 194 A, 194 B, 273/193 R, 193 A, 193 B, 81.2, 81.4, 81 B, 81 D, 186 C, 183 D, 186 A

[56] References Cited

U.S. PATENT DOCUMENTS 1,573,612 2/1926 Johnston ..... 273/165

4,600,195 7/1986 Hunter ..... 273/81 A

*Primary Examiner*—George J. Marlo

*Attorney, Agent, or Firm*—Renner, Kenner, Greive, Bobak, Taylor & Weber

[57] ABSTRACT

A golfer's training device (10) weighing in the range of three to four pounds includes an upper body portion (11) and a lower body portion (12). The body portions are attached at one end by a hinge member (13) and internally define a cavity (14) corresponding to the configuration at the grip area (15) of a golf club (16). The two body portions (11, 12) are closed onto the grip end (15) of the golf club (16) and secured by a hook latch (19). The increased weight on the grip end (15) of the golf club (16) changes the center of gravity of the club (16) to a point closer to the grip end (15) than with a normal club. The increased weight on the grip end (15) helps slow down the golf swing, which allows the golfer to analyze the swing and make corrections while exerting the same muscle force as if making a normal swing. Thus the corrected swing becomes a learned muscle behavior and a reflexive action.

5 Claims, 3 Drawing Sheets

GOLFER'S TRAINING DEVICE

TECHNICAL FIELD

This invention relates to a device used during practice to train certain muscles used by a golfer and help improve his golf swing. More particularly, the invention relates to a device which can be attached to a conventional golf club, giving the club a weighted, oversized grip end.

BACKGROUND ART

A standard golf club consists essentially of a grip end, a club head, and an elongate shaft therebetween. With most of the weight of the club near the club head, the center of gravity of the club is usually approximately six inches above the club head which is desirable for striking a golf ball and obtaining the maximum distance from the hit.

The golf swing can be thought of as a sequential, smooth-flowing body action which accelerates the head of a golf club along an elliptical path to contact a ball. Consistency in this body action is necessary for a golfer to achieve maximum efficiency, i.e., maximum range and accuracy in hitting the ball. To achieve this consistency, it is necessary that the golfer practice the golf swing with some regularity so that the sequential movement of the body muscles becomes a learned behavior and a reflexive action.

One common mistake made by golfers is the introduction into the swing of a chopping down motion rather than the smooth, sequential action which is desired. With the center of gravity of the club being just above the club head, the tendency for this undesirable motion is accentuated. This is because there is a natural tendency to move the hands toward the center of gravity in order to retain a secure hold on the grip end. This movement gives rise to the chopping motion, which is detrimental to the efficiency of the golf swing.

A second common mistake made by golfers during the swing movement is undue tension in the wrist and arms. It is important that during the swing, the wrists not break or cock prematurely. Increased tension often leads to such premature movement.

As with any repeated activity, unless proper practice procedures are developed these flaws may become a learned muscle behavior just as easily as correct and efficient muscle movements. The golf swing with these correct muscle movements results in the acceleration of the club head as fast as possible thereby obtaining the maximum distance of the hit ball. However, it is often impossible during a fast swing for the golfer to concentrate on each muscle movement in sequence unless, through practice, the proper swing is second nature to him. It is not desirable to slow a swing down in order to achieve the requisite concentration because this does not allow for maximum club acceleration. Therefore, the golfer must repeatedly practice the proper swing with maximum acceleration. Anything less would promote a learned muscle behavior at a sub-par level.

It has been known to make training golf clubs having weighted club heads. This type of club does not serve to correct the common problems of a golfer's swing but rather, at best, only serves to loosen up the muscles at the outset of a round of golf. In fact, with the center of gravity at the same position, and the overall weight increased, the incorrect swing deficiencies are not corrected, but are actually increased to compensate for the added weight. With such a device, the downward chopping motion and the premature break of the wrists are therefore encouraged rather than repressed.

DISCLOSURE OF THE INVENTION

It is thus a primary object of the present invention to provide a training device which will help a golfer develop a golf swing having maximum efficiency.

It is a further object of the present invention to provide a training device, as above, which when attached to a standard golf club, will change the center of gravity of the club to a point adjacent the grip end of the club.

It is still another object of the present invention to provide a training device, as above, which will allow the golfer to practice the golf swing with maximum muscle exertion, as if giving rise to maximum club head velocity, while at the same time restricting the velocity so that the golfer may concentrate on each sequential muscle action.

These and other objects of the present invention, which will become apparent from the description to follow, are accomplished by the means hereinafter described and claimed.

In general, the training device for use with a golf club having a grip area includes a body member having upper and lower body portions swingably connected to each other at one end by a hinge member. A cavity in the body member corresponds in configuration to the grip area of the golf club so that when the training device is attached to the grip area of the club, the weight of the training device shifts the center of gravity of the golf club to a position near the grip area.

PREFERRED EMBODIMENT FOR CARRYING OUT THE INVENTION

Figure 1:
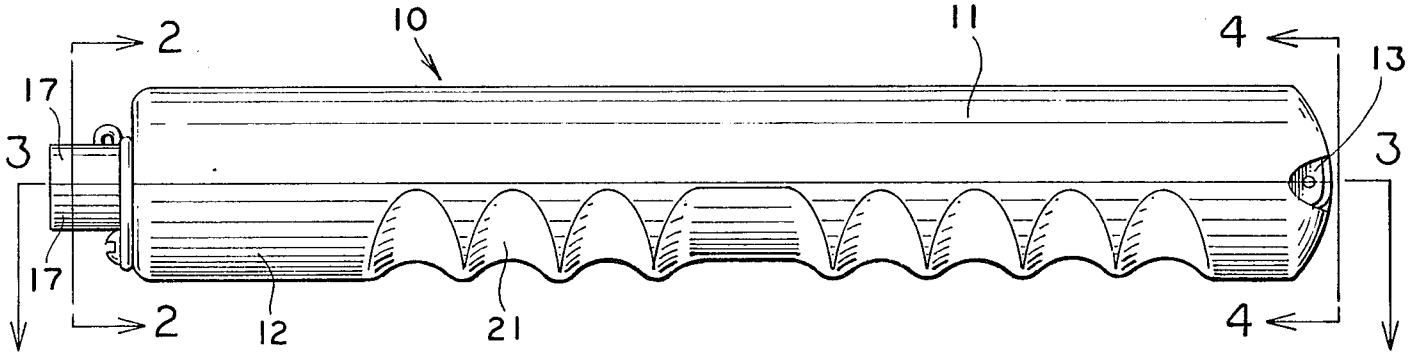
FIG. 1 is a side elevational view of a training device embodying the concepts of the present invention.
Figure 2:
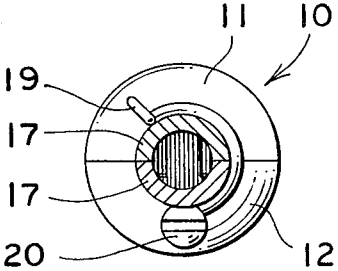
FIG. 2 is an end elevational view taken substantially along line 2—2 of FIG. 1.

A golf swing training device embodying the concept of the present invention is generally indicated by the numeral 10 in FIG. 1. Training device 10 includes a body member having an upper body portion 11 and a lower body portion 12 connected at one end by a hinge 13.

Figure 3:
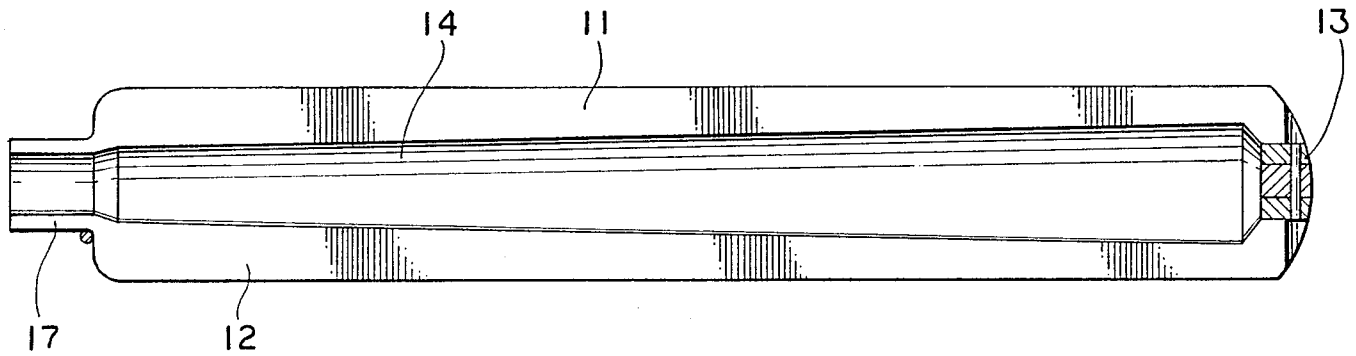
FIG. 3 is a cross-section taken substantially along line 3—3 of FIG. 1.
Figure 4:
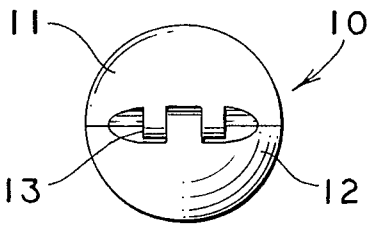
FIG. 4 is an end elevational view taken substantially along line 4—4 of FIG. 1.
Figure 5:
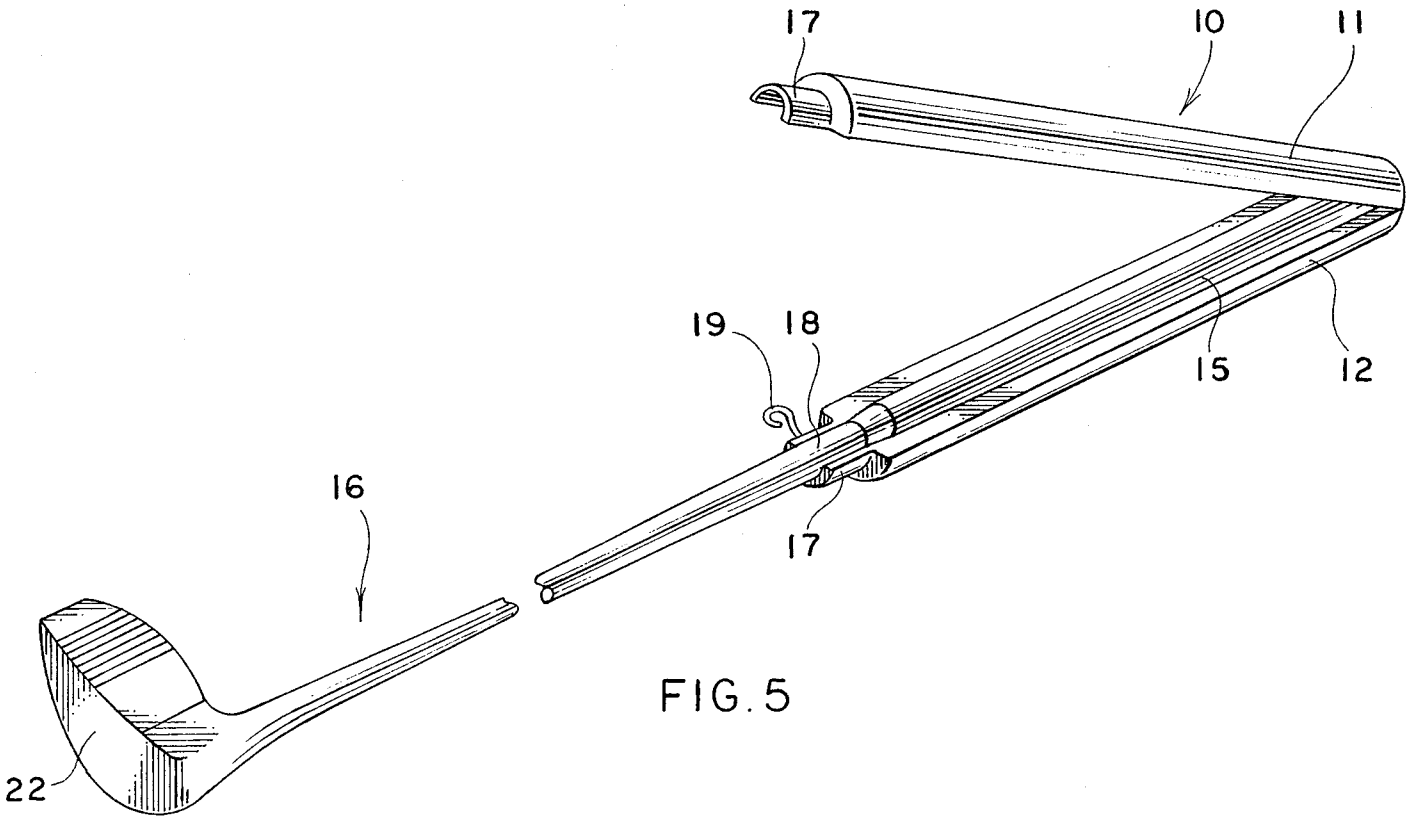
FIG. 5 is a perspective view of the training device of FIG. 1, shown partially in place on the grip end of a partially broken away golf club.

As best shown in FIG. 3, each body portion 11 and 12 is semi-cylindrical in configuration and is internally tapered inwardly from the end adjacent hinge 13 to the other end so as to form a cavity 14 approximately corresponding to the configuration of the grip end 15 of a standard golf club 16. As shown in FIG. 6, when body portions 11 and 12 are in the closed position, the grip end 15 of golf club 16 is closely confined by training device 10.

The end of each body portion 11 and 12 opposite hinge 13 is provided with a semi-circular flange 17. Together, the flanges 17 on body portions 11 and 12 engage a portion of the golf club shaft 18 to more securely position the device 10 onto the golf club 16. Such positioning is accomplished by a conventional hook latch 19 which is connected to body portion 11 and hooks onto a screw 20 in the end of body portion 12 to hold flanges 17 together, thus securing the device 10 to the club 16.

In use, the body portions 11 and 12 are separated by pivoting at hinge 13 and the grip end 15 of a golf club 16 is placed into cavity 14. The two body portions are closed so as to be in lengthwise contact along grip 15 and secured together by hook latch 19. It can be seen that the device 10 outwardly resembles an oversized golf club grip, and it may be provided with undulations 21 resembling finger slots to help the user obtain a more secure grip.

Body portions 11 and 12 are preferably made of some relatively heavy material, such as cast iron, thereby moving the center of gravity of a standard club 16 from the normal point just above the club head 22, to a point along club shaft 18 just below the grip end 15. It has been found that a device weighing in the range of three to four pounds and preferably approximately three pounds eight ounces will change the center of gravity of almost all standard golf clubs in the same manner to a point approximately 11 inches from the end of the grip end 15, thus, much closer to the hands of the user. While there is still a natural tendency to move the hands toward the center of gravity of the club, the detrimental effect on the golf swing is reduced by moving the center of gravity closer to the hands. Therefore, the downward, chopping motion which accompanies this movement is reduced. Repeated practice with the device 10 in place will lead to a reflexive muscle action eliminating the chopping down motion.

The increased weight of the grip end 15 carrying a training device 10 will, of course, strengthen a golfer's muscles over time, as with any repetitive exercise with a weight. It has also been found that with the training device 10 the golfer will expend the same muscular effort as when swinging an unweighted club for maximum club head velocity, but without being concerned about velocity the user may better concentrate on each sequential movement of the muscles involved. The increased weight of the grip end 15 forces the golfer to make a slower swing with the same amount of muscle force as if the swing were accomplished with maximum club head velocity. Therefore, the golfer is able to concentrate on each muscle movement, analyzing and correcting defects, which correction would have been less likely if practicing at normal swing velocities. But the muscle behavior during this training is the same as when using an unweighted golf club and thus the correct golf swing becomes a learned muscle behavior and a reflexive action. The golfer will then be able to use a normal golf club, and exert the same amount of muscle force in the learned sequential muscle pattern, achieving maximum golf swing efficiency.

It has further been found that the oversize grip end and increased weight also help to reduce the premature break of the wrists. The increased weight and size helps to reduce muscle tension, which together with the increased concentration which is promoted by the slower swing, helps the golfer maintain the correct wrist position. Once the correct movement becomes a learned behavior, the swing can be made at normal velocities without the heightened conscious thought.

It is to be appreciated that the embodiment of the present invention described here and depicted in the drawings is exemplary of one of many such embodiments all within the concept of the invention. It is envisioned that a one-piece device, or an integrally formed golf club and device may still be within the scope of the claims herein.

It should thus be apparent that the golfer's training device described herein efficiently accomplishes the objectives of the present invention.

We claim

1. A training device for use with a golf club having a grip area and golf head separated by an elongate shaft, the device comprising a body member having a cavity therein generally corresponding to the configuration of the grip area of the golf club, said body member including an upper body portion and a lower body portion, hinge means at one end of said body member so that said upper body portion may be moved away from and toward said lower body portion to selectively surround the grip area of the golf club, said body member having a substantially larger diameter than the grip area and weighing in the range of three to four pounds so as to move the center of gravity of the golf club to a point adjacent the grip area.

2. A training device according to claim 1 further comprising means at the other end of said body member to attach said lower body portion to said upper body portion to hold said body member on the golf club.

3. A training device according to claim 2 further comprising a flange on said other end of said body member, said means to attach engaging said flange.

4. A training device according to claim 1 further comprising undulations in the outer surface of said lower body portion.

5. A training device according to claim 1 wherein said body member weighs approximately three pounds eight ounces.

* * * * *